US012215951B2

(12) United States Patent
Noonan

(10) Patent No.: US 12,215,951 B2
(45) Date of Patent: Feb. 4, 2025

(54) FIREARM WITH SPARE MAGAZINE STORAGE FACILITY

(71) Applicant: F.M. Products Inc, Boise, ID (US)

(72) Inventor: Paul T. Noonan, Boise, ID (US)

( * ) Notice: Subject to any disclaimer, the term of this patent is extended or adjusted under 35 U.S.C. 154(b) by 0 days.

(21) Appl. No.: 18/524,314

(22) Filed: Nov. 30, 2023

(65) Prior Publication Data

US 2024/0102757 A1 Mar. 28, 2024

Related U.S. Application Data

(63) Continuation of application No. 16/531,279, filed on Aug. 5, 2019, now Pat. No. 11,874,081, which is a continuation of application No. 15/421,952, filed on Feb. 1, 2017, now Pat. No. 10,415,909.

(51) Int. Cl.

| | |
|---|---|
| ***F41A 9/68*** | (2006.01) |
| ***F41A 17/38*** | (2006.01) |
| ***F41C 23/22*** | (2006.01) |
| *F41A 9/38* | (2006.01) |

(52) U.S. Cl.

CPC ..... *F41A 9/68* (2013.01); *F41A 17/38* (2013.01); *F41C 23/22* (2013.01); *F41A 9/38* (2013.01)

(58) Field of Classification Search

CPC .... F41A 17/38; F41A 9/61; F41A 9/65; F41A 9/68; F41C 23/22; F41C 27/00

See application file for complete search history.

(56) References Cited

U.S. PATENT DOCUMENTS

| | | | | |
|---|---|---|---|---|
| 3,939,590 | A * | 2/1976 | Musgrave | F41A 9/83 42/106 |
| 4,115,943 | A * | 9/1978 | Musgrave | F42B 39/02 42/71.01 |
| 5,159,136 | A * | 10/1992 | Marsh | F41C 23/22 42/71.01 |
| 6,536,152 | B1 * | 3/2003 | Wisz | F41C 23/22 42/95 |
| 6,829,855 | B2 * | 12/2004 | Seifert | F41C 23/22 42/71.01 |
| 6,981,344 | B2 * | 1/2006 | Cahill | F41C 23/10 D22/104 |
| 2003/0136044 | A1 * | 7/2003 | Williams | F41A 29/00 42/95 |
| 2017/0074616 | A1 * | 3/2017 | Petersen | F41A 23/04 |
| 2017/0199000 | A1 * | 7/2017 | Paquette | F41A 17/38 |

* cited by examiner

*Primary Examiner* — Benjamin P Lee

(57) ABSTRACT

The present disclosure is directed to a firearm capable of holding more than one magazines. In a particular embodiment, the firearm can include an operational magazine well adapted to receive an operational magazine and a secondary magazine well adapted to receive a secondary magazine, wherein the secondary magazine well is nonoperational.

5 Claims, 12 Drawing Sheets

FIREARM WITH SPARE MAGAZINE STORAGE FACILITY

CROSS REFERENCE TO RELATED APPLICATIONS

This application is a continuation of U.S. patent application Ser. No. 16/531,279 titled "Firearm With Spare Magazine Storage Facility" filed Aug. 5, 2019, now issued U.S. Pat. No. 11,874,081, which is incorporated herein by reference in its entirety. U.S. patent application Ser. No. 16/531,279 is a continuation of U.S. patent application Ser. No. 15/421,952 titled "Firearm With Spare Magazine Storage Facility" filed Feb. 1, 2017, now issued U.S. Pat. No. 10,415,909, which is incorporated herein by reference in its entirety.

FIELD OF THE INVENTION

The present invention generally relates to firearms, and more particularly to firearms capable of holding more than one magazine.

BACKGROUND OF THE INVENTION

It is often desirable to carry additional magazines for a firearm to provide for more rounds of shooting capacity. Options include belts and holsters to carry the additional magazines. Other options include a second magazine attached to the first, and spare magazines stored in a rifle buttstock. However, these options can be cumbersome and can slow a user in reloading their firearm with a new magazine.

Therefore, there is a need to provide a firearm that has the ability to carry a spare magazine within the firearm that is both easy and quick to access for reloading. In this regard, various embodiments of the present disclosure substantially fulfill at least some of these needs. In this respect, certain embodiments of the firearm or methods according to the present disclosure substantially departs from the conventional concepts and designs of the prior art, and in doing so provides an apparatus and method that provides the ability to carry a secondary magazine within the firearm and quickly reload an operational magazine well with the secondary magazine.

SUMMARY OF THE INVENTION

The present disclosure provides an improved firearm and method of reloading a firearm, and overcomes the above-mentioned disadvantages and drawbacks of the prior art. As such, the general purpose of the present invention, which will be described subsequently in greater detail, is to provide an improved firearm and method of reloading a firearm that has all the advantages of the prior art mentioned above.

To attain this, one embodiment of the present disclosure includes a firearm comprising a frame having a rear end and a forward end opposite the rear end, wherein the frame comprises: a grip; an operational magazine well adapted to receive an operational magazine; and a secondary magazine well adapted to receive a secondary magazine, wherein the secondary magazine well is nonoperational.

In particular embodiments, the secondary magazine well can be disposed within the grip.

In further embodiments, the firearm can include an operational magazine release operable by a user's index finger on their predominant hand gripping the firearm in a firing position.

In even further embodiments, the firearm can include a secondary magazine release operable by a user's thumb on their predominant hand gripping the firearm in a firing position.

There has thus been outlined, rather broadly, the more important features of one embodiment of the present disclosure in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
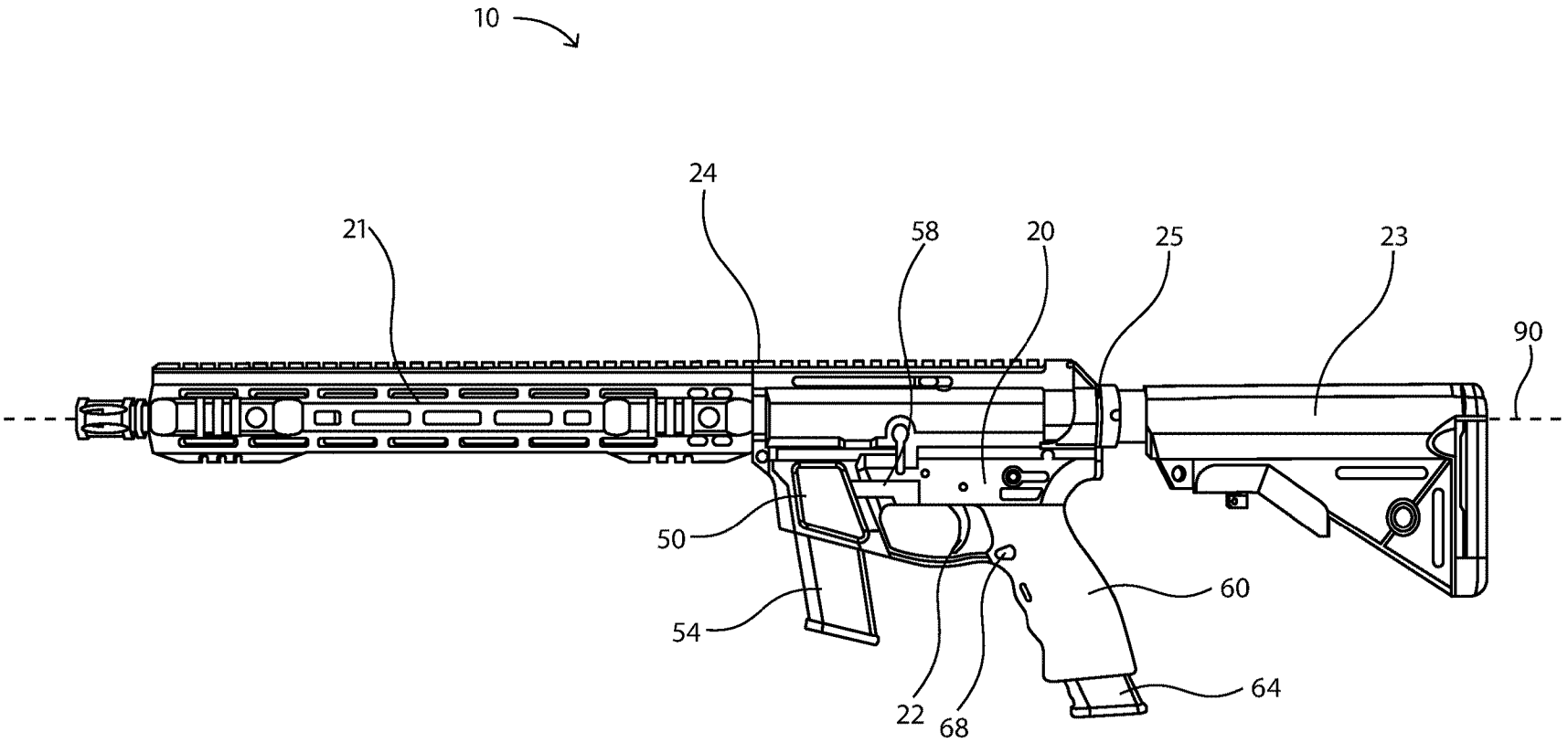
FIG. 1 is a side view of a firearm according to an embodiment of the present disclosure.
Figure 2:
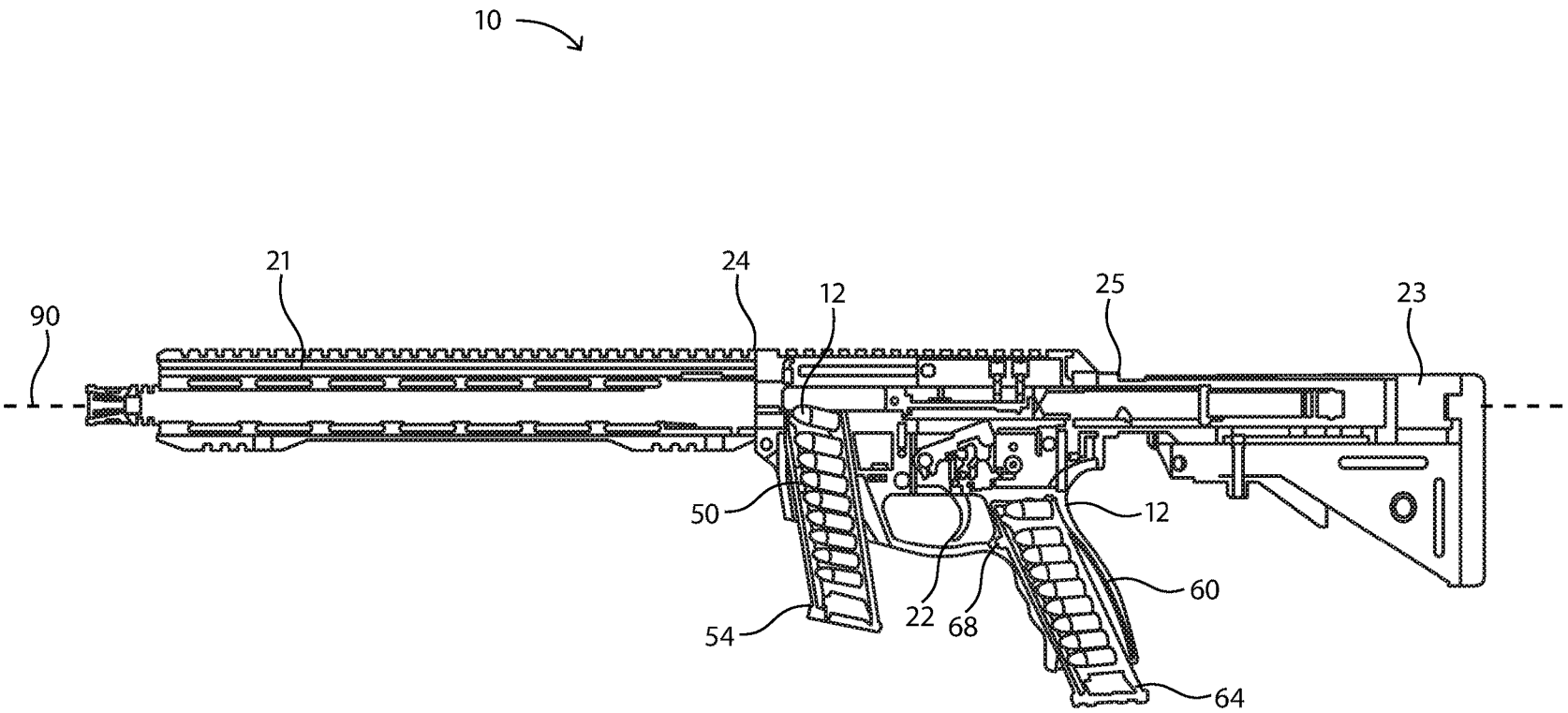
FIG. 2 is a cross-sectional side view of the firearm of FIG. 1.
Figure 3:
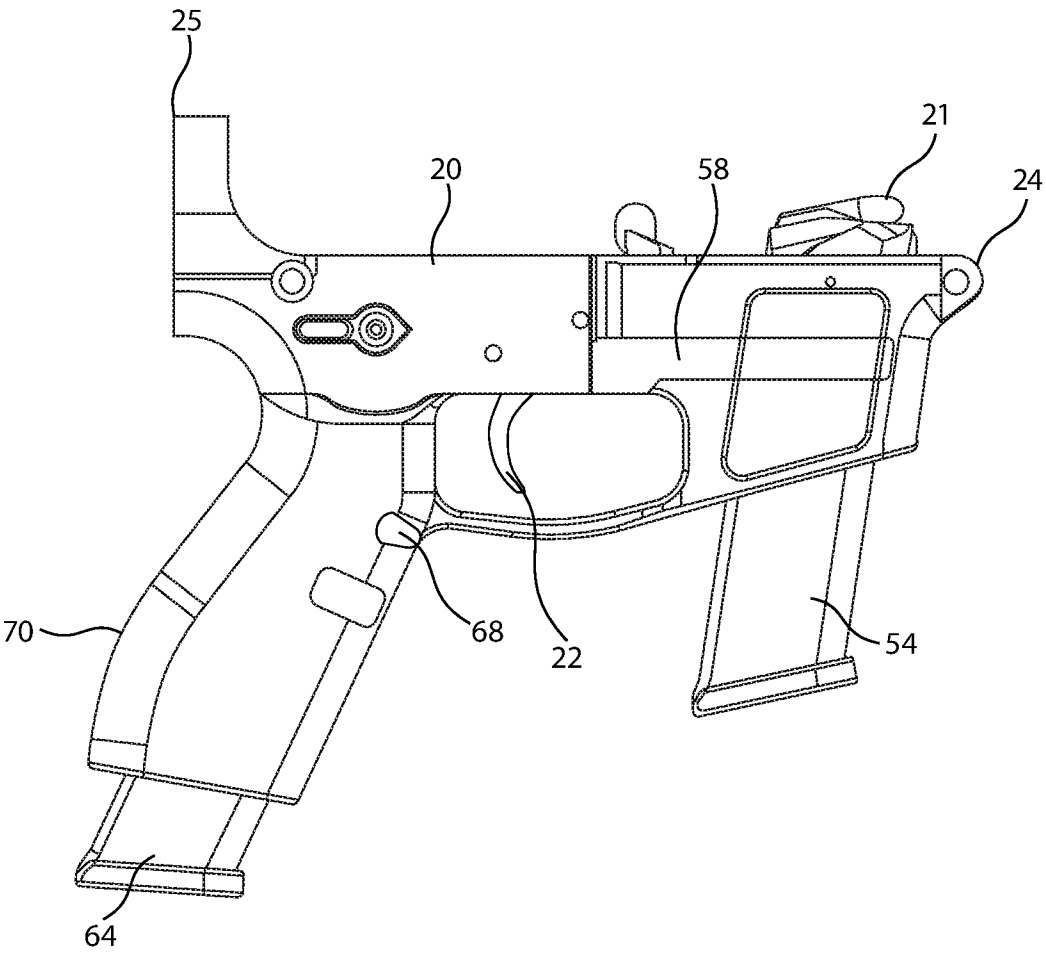
FIG. 3 is a side view of the frame of the firearm of FIG. 1.
Figure 4:
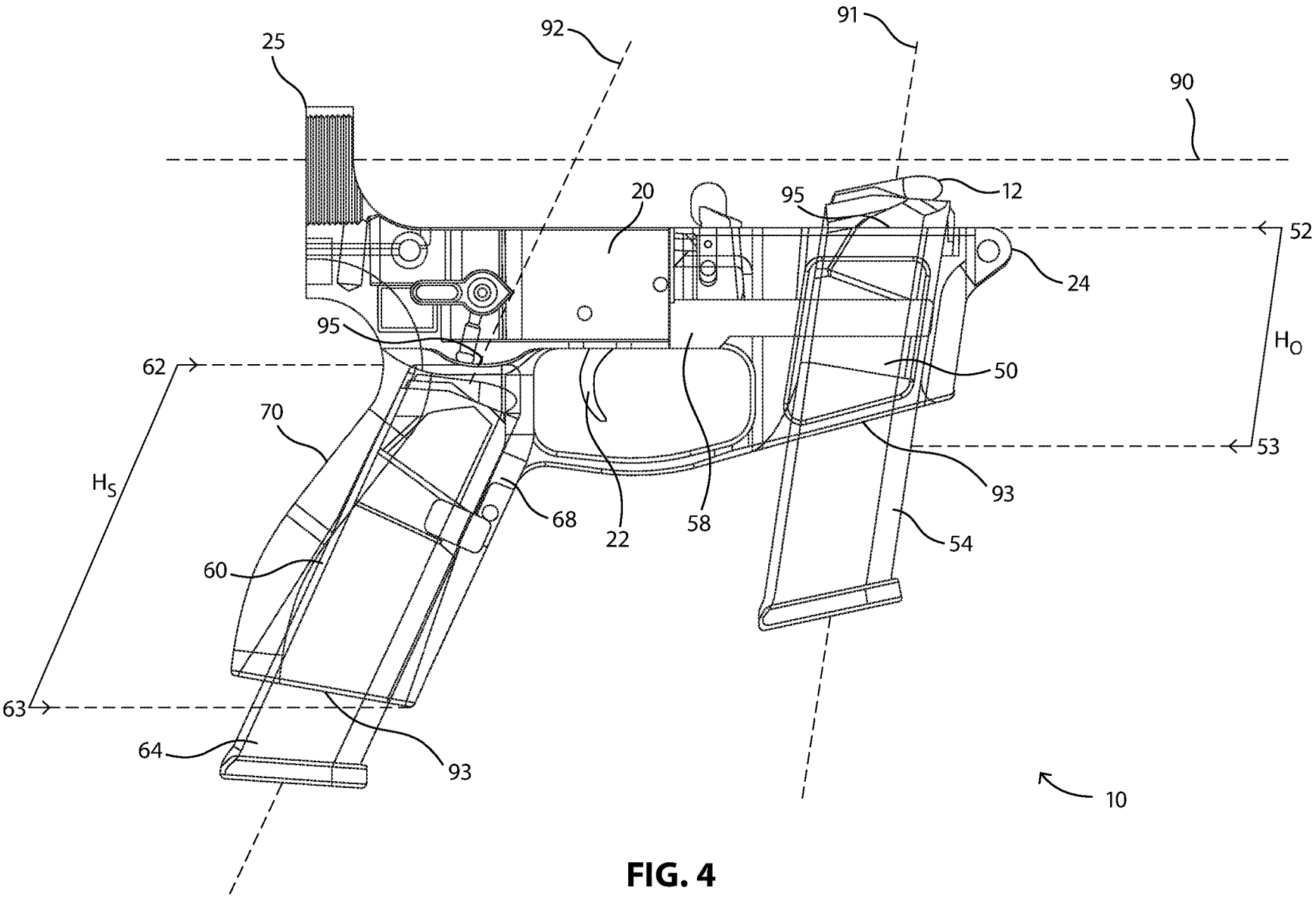
FIG. 4 is a cross-sectional side view of the frame of FIG. 3.

Referring now to FIGS. 1-4, there is shown a firearm 10 according to one embodiment of the present disclosure. FIGS. 1-2 illustrate a complete firearm that includes a frame 20, a barrel 21, and a butt 23, while FIGS. 3-4 illustrate the frame of the firearm in greater detail.

The frame 20 can have a forward end 24 and a rear end 25 opposite the forward end 24. The frame 20 can include an operational magazine well 50 and a secondary magazine well 60. The magazine wells 50, 60 can be adapted to receive and hold a magazine in each magazine well.

The operational magazine well 50 can be operational, while the secondary magazine well 60 can be non-operational. For example, the operational magazine well 50 can have an upper end 52 that is open, allowing a projectile 12 in the operational magazine 54 to be transferred to a firing assembly and fired from the firearm 10. Put another way, the operational magazine can be in communication with a passage within the firearm in which a bolt reciprocates to feed cartridges from the magazine into a well at the breech end of the barrel 21. In contrast, the secondary magazine well 60 can have an upper end 62 that is closed, such that a projectile 12 in the secondary magazine 64 cannot be transferred to a firing assembly and the barrel 21 within the frame 20.

The fact that the upper end of the well 60 may be closed is not necessary to get the operational benefits of the invention, but it does provide a secondary benefit of avoiding a potential entry point for debris or other contamination that may occur in some firearms. For instance, gas-operated firearms are said to "exhaust where they feed" and the soot from the exhaust gas can coat surfaces that are in communication with the bolt passage. While this is not generally a problem for a primary magazine in a gas-operated semi-automatic rifle because the cartridges are consumed as they might be dirtied, a spare magazine and its top exposed cartridge might remain in place for not just many shots, but many magazines. Thus, protecting a reserve magazine from such potential contamination helps to ensure that the exposed top rounds are clean and readily feedable when needed.

The frame 20 can further include a trigger 22 operable to initiate firing of a projectile 12 from the firearm 10. The trigger 22 can be disposed between the operational magazine well 50 and the secondary magazine well 60. For example, the operational magazine well 50 can be disposed forward of the trigger 22 and closer to the forward end 24 of the frame 20 than the secondary magazine well 60. The secondary magazine well 60 can be disposed behind the trigger 22 and closer to the rear end 25 of the frame 20 than the operational magazine well 50.

In particular embodiments, the secondary magazine well 60 can be disposed within the grip 70.

The operational magazine well 50 and the secondary magazine well 60 can have different lengths between their respective upper ends 52, 62 and a bore axis 90 of the barrel 21. In particular embodiments, the upper end 52 of the operational magazine well 50 can be closer to the bore axis 90 of the barrel 21 than the upper end 62 of the secondary magazine well 60.

The operational magazine well 50 can also be at a different general major angle than the secondary magazine well 60. As particularly illustrated in FIG. 4, the operational magazine well 50 can have a general major angle $\alpha$ with respect to the barrel bore axis 90 that is greater than a general major angle $\beta$ of the secondary magazine well 60 with respect to the barrel bore axis 90. The general major angle is measured at the intersection of the magazine center line 91, 92 as measured between the centerpoint 93 from the an inner cross-sectional profile at a lower end 53, 63 and the centerpoint 95 from an inner cross-sectional profile at the upper end 52, 62 to the bore axis 90 of the barrel 21.

Figure 5:
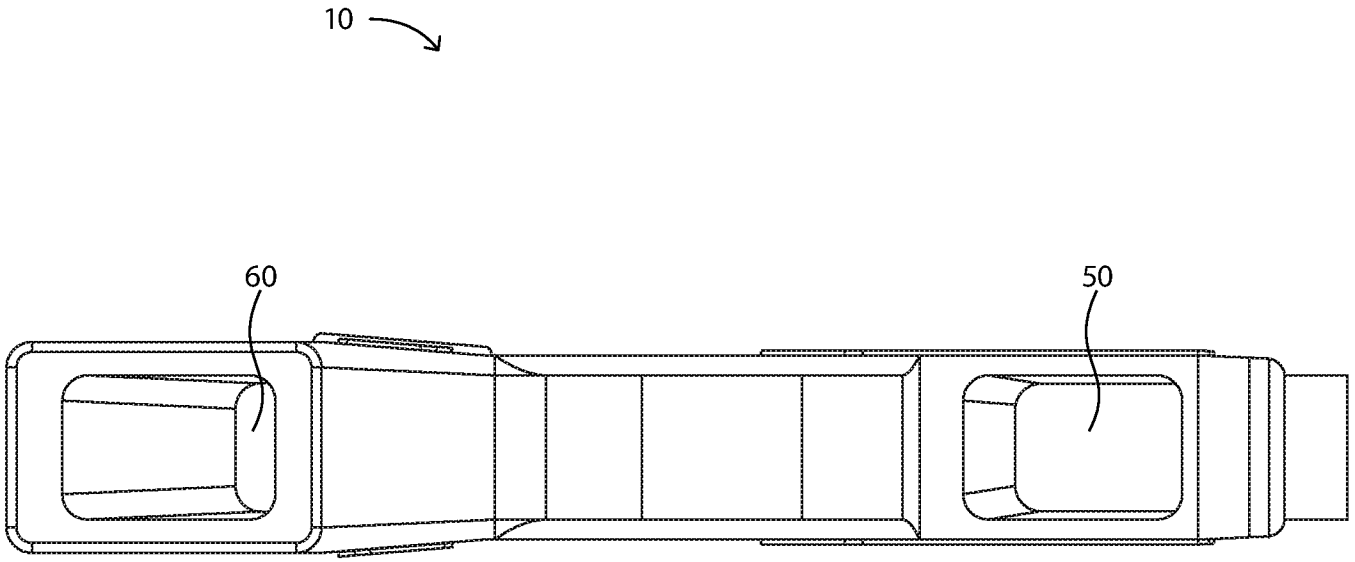
FIG. 5 is a bottom view of the frame of FIG. 3, excluding the magazines.

Referring now to FIG. 5, which illustrates a bottom view of the frame excluding the magazines, an inner cross-sectional profile 55 of the operational magazine well 50 can be complementary to an inner cross-sectional profile 65 of the secondary magazine well 60, such that a magazine that is being stored in the secondary magazine well can be released and inserted into the operational magazine well. This means that a magazine fits in both wells in the same way in essentially all respects. The fit is equally close, but also readily enabling the magazine to be inserted and extracted without undue force. In some instances the magazine is desired to "drop-free" under its own weight even when empty when a latch is released. There may be some differences that do not affect the functional interface between magazine and well, such as extra voids between a flat magazine side panel and a curved grip wall, in order to provide consistent wall thicknesses, moldability, machinability, material conservation, or weight reduction.

The secondary magazine well 60 can have a longer height Hs than the height Ho of the operational magazine well 50. For example, a larger portion of the magazine length can be outside of the magazine well when that magazine is in the operational magazine well versus the secondary magazine well. The height of a magazine well is measured as the distance between the upper end 52, 62 and the lower end 53, 63 of the magazine well. Also, some firearm platforms provide magazines of different lengths and capacities that are compatible with the same firearm, including short magazines for compact pistols, with long magazines being accepted by those pistols, and extended capacity magazines holding 30 rounds also being useable while protruding greatly from a pistol, all with the same upper portion and release latch features at the same locations with respect to the upper end. The wells of the illustrated embodiment may accommodate any of a wide range of compatible magazines and enable different strategies for loading, including larger or smaller magazines in either location, depending where protrusions are more acceptable or disadvantageous.

Figure 6:
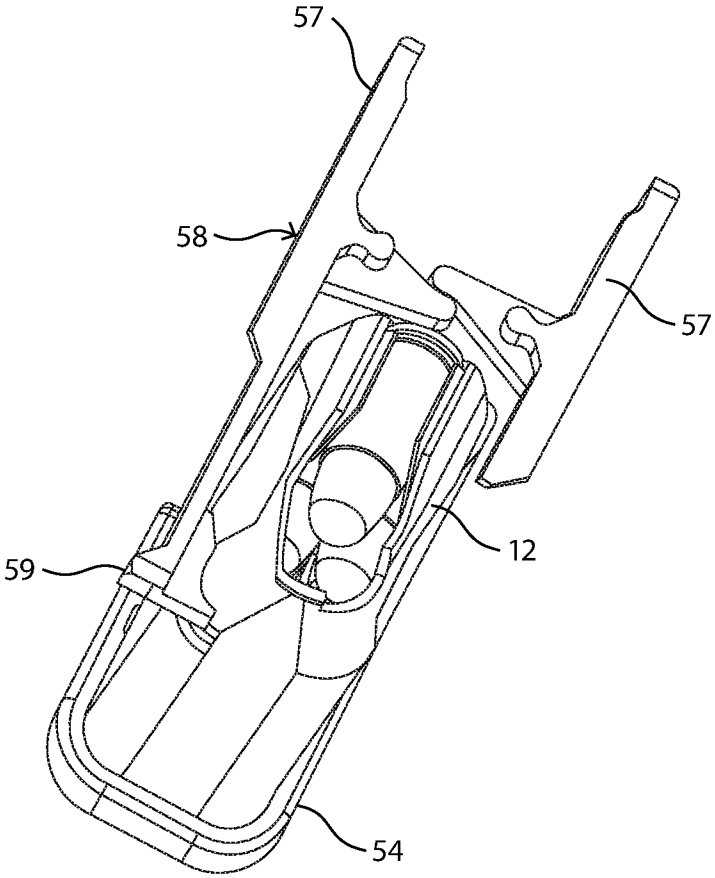
FIG. 6 is a perspective view of an operational magazine and an operational magazine release according to an embodiment of the present disclosure.
Figure 8:
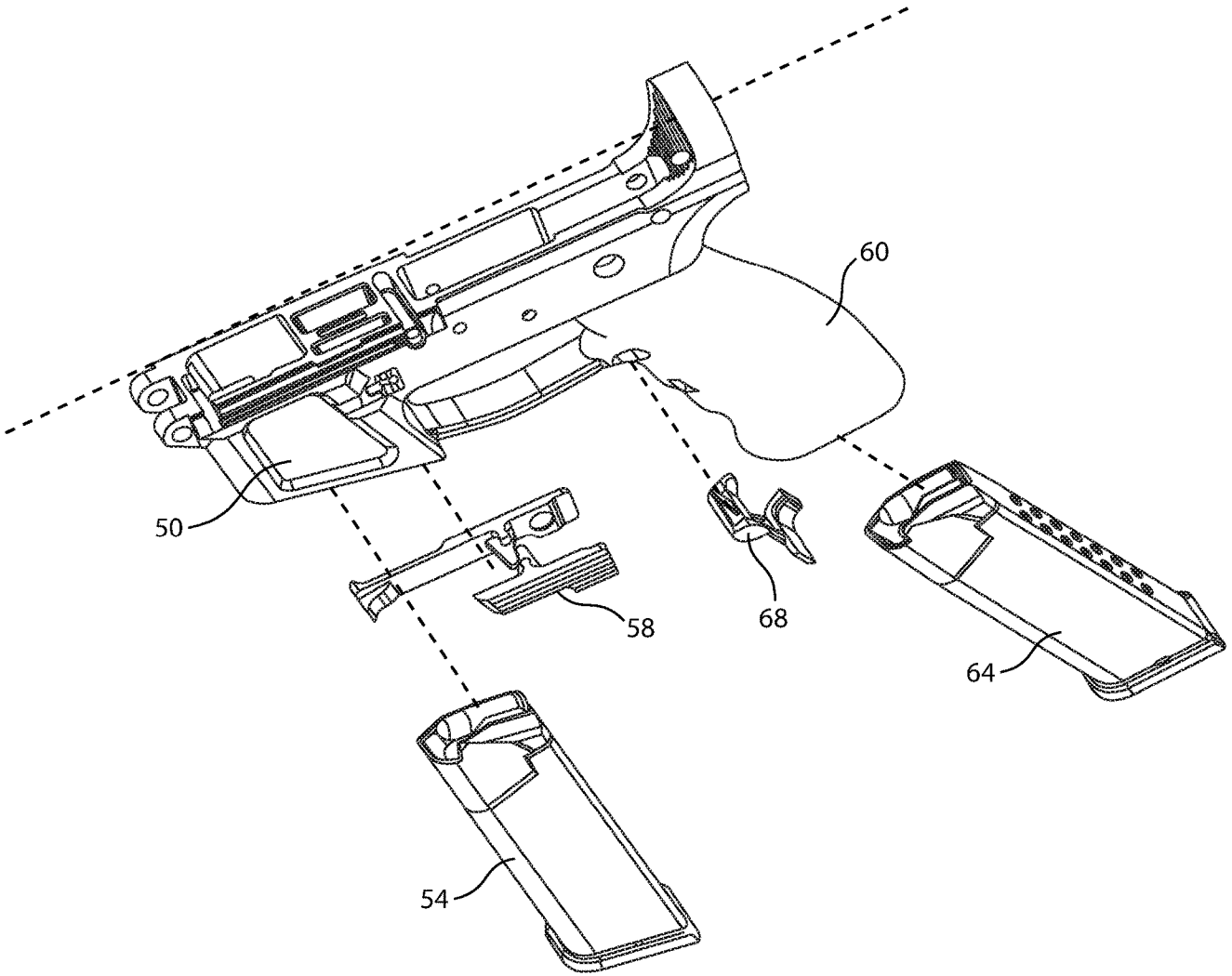
FIG. 8 is an exploded perspective view of particular components of a firearm frame according to an embodiment of the present disclosure.

The firearm 10 can have an operational magazine release 58 operable to release an operational magazine 54 from the operational magazine well 50. The operational magazine release 58 can be disposed closer to the forward end 24 of the frame 20 than the trigger 22. The operational magazine release 58 can be adapted to be operable with a user's index or trigger finger of the dominant "firing" hand when griping the firearm in a firing position. The operational magazine release 58 can be actuated by a user applying force in a direction generally transverse to the barrel bore axis 90 and the major vertical plane of the firearm. As particularly illustrated in FIGS. 6 and 8, the operational magazine release 58 can include a two piece construction on opposite sides of the frame that engage with each other through the frame. When a user depresses the magazine release initiation area 57 on either side of the firearm toward the frame 20, a latch 59 is released that holds the magazine within the well. Of particular note, this construction allows either a left-handed or right-handed user to actuate the operational magazine release 58 with the index finger of their predominant hand while gripping the firearm in the firing position.

Figure 7:
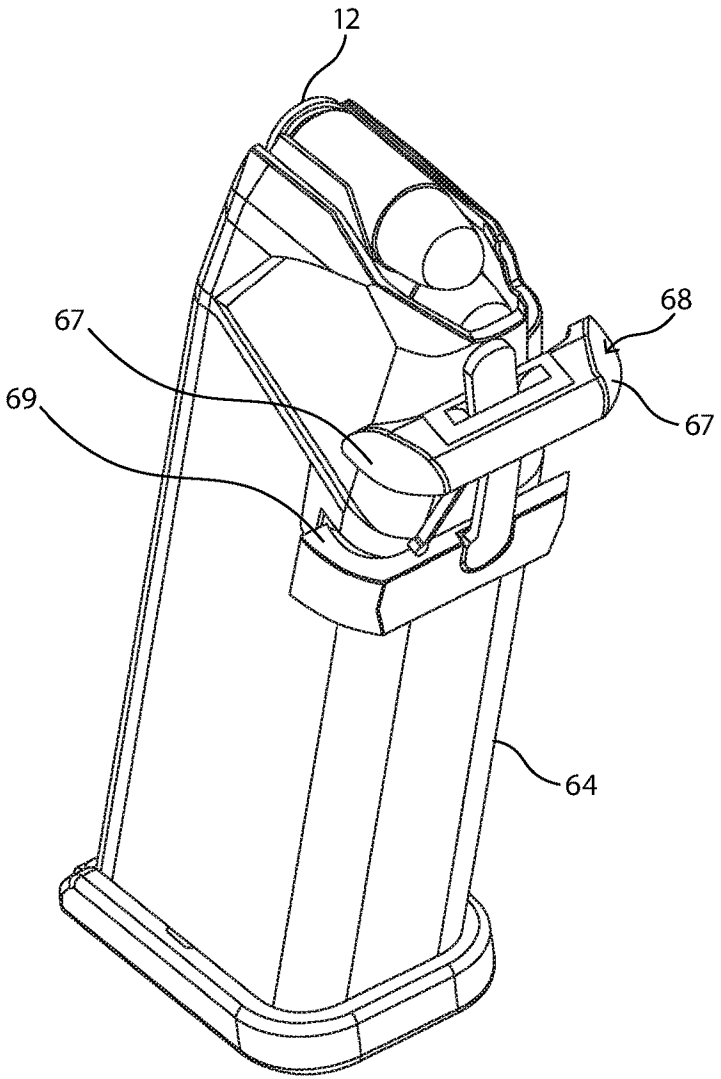
FIG. 7 is a perspective view of a secondary magazine and a secondary magazine release according to an embodiment of the present disclosure.

The secondary magazine well can have a secondary magazine release 68 operable to release the secondary magazine 64 from the secondary magazine well 60. The secondary magazine release 68 can be disposed closer to the rear end 25 of the frame 20 than the trigger 22. The secondary magazine release 68 can be adapted to be operable with a user's thumb when griping the firearm in a firing position. In particular embodiments, the secondary magazine release 68 can be disposed on the grip 70. The secondary magazine release 68 can be actuated by a user applying force in a direction generally perpendicular to the bore axis 90 of the barrel 21. For example, as particularly illustrated in FIGS. 7 and 8, the secondary magazine release 68 can include a three-piece construction. When a user depresses the magazine release initiation area 67 inward, toward the frame 20, a latch 69 is released that was holding the magazine 64 within the secondary magazine well 60.

In particular embodiments, both the operational magazine release 58 and the secondary magazine release 68 are operable by the user's index finger and thumb respectively, on the same hand, such as the predominant hand, when griping the firearm in a firing position. The user can thus conveniently release the desired magazine(s) without removing their predominant hand from the firing position.

Of particular note, this construction allows either a left-handed or right-handed user to actuate the secondary magazine release 68 with their thumb when griping the firearm in the firing position.

Figure 9:
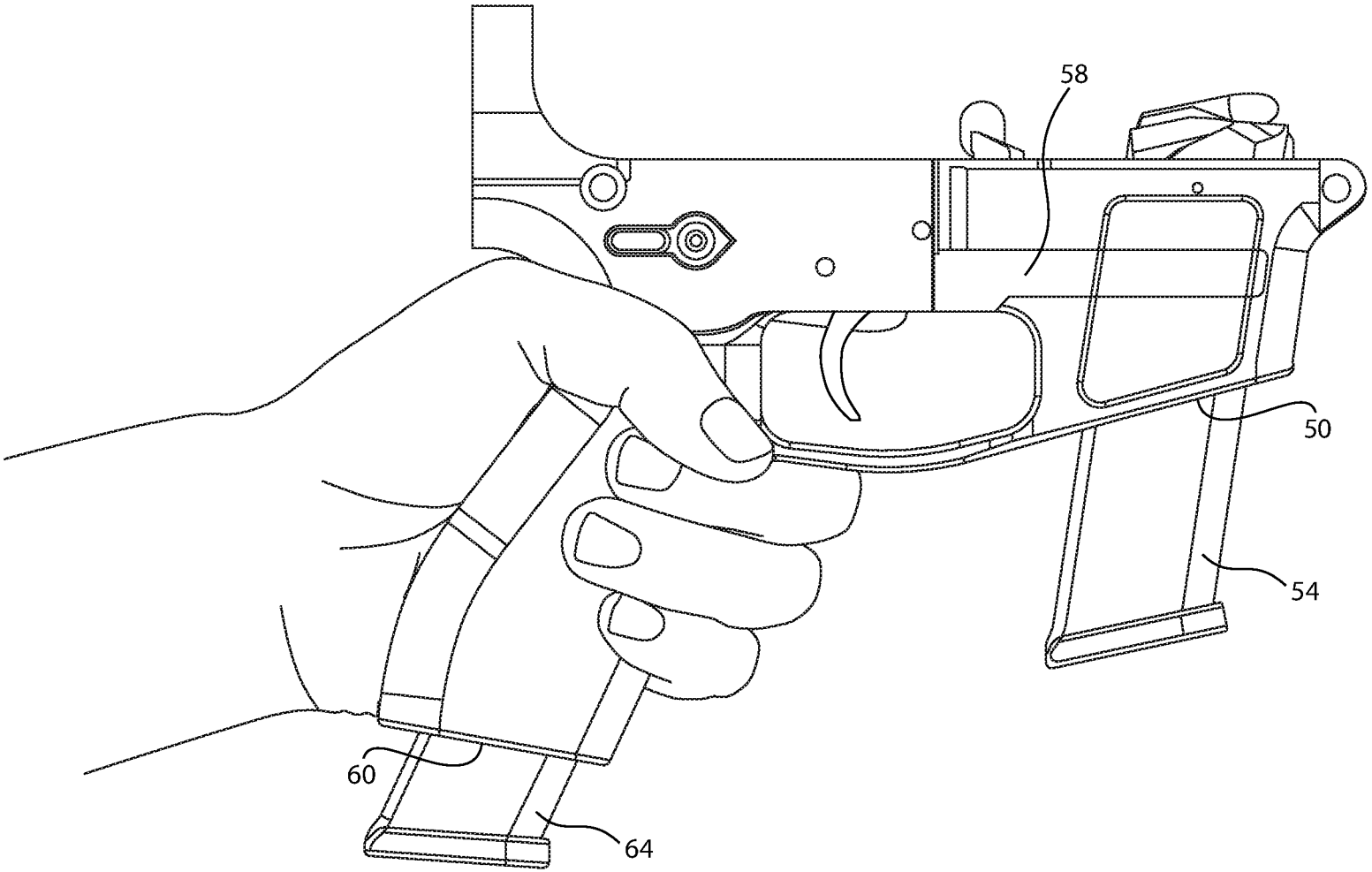
FIG. 9 is a side view of a firearm according to an embodiment of the present disclosure being gripped by a user in the firing position.

Another aspect of the present disclosure is a method for reloading a firearm. Referring to FIG. 9, an exemplary firearm 10 is illustrated in the fully loaded position. Magazines 54, 64 are disposed in the operational magazine well 50 and the secondary magazine well 60.

Figure 10:
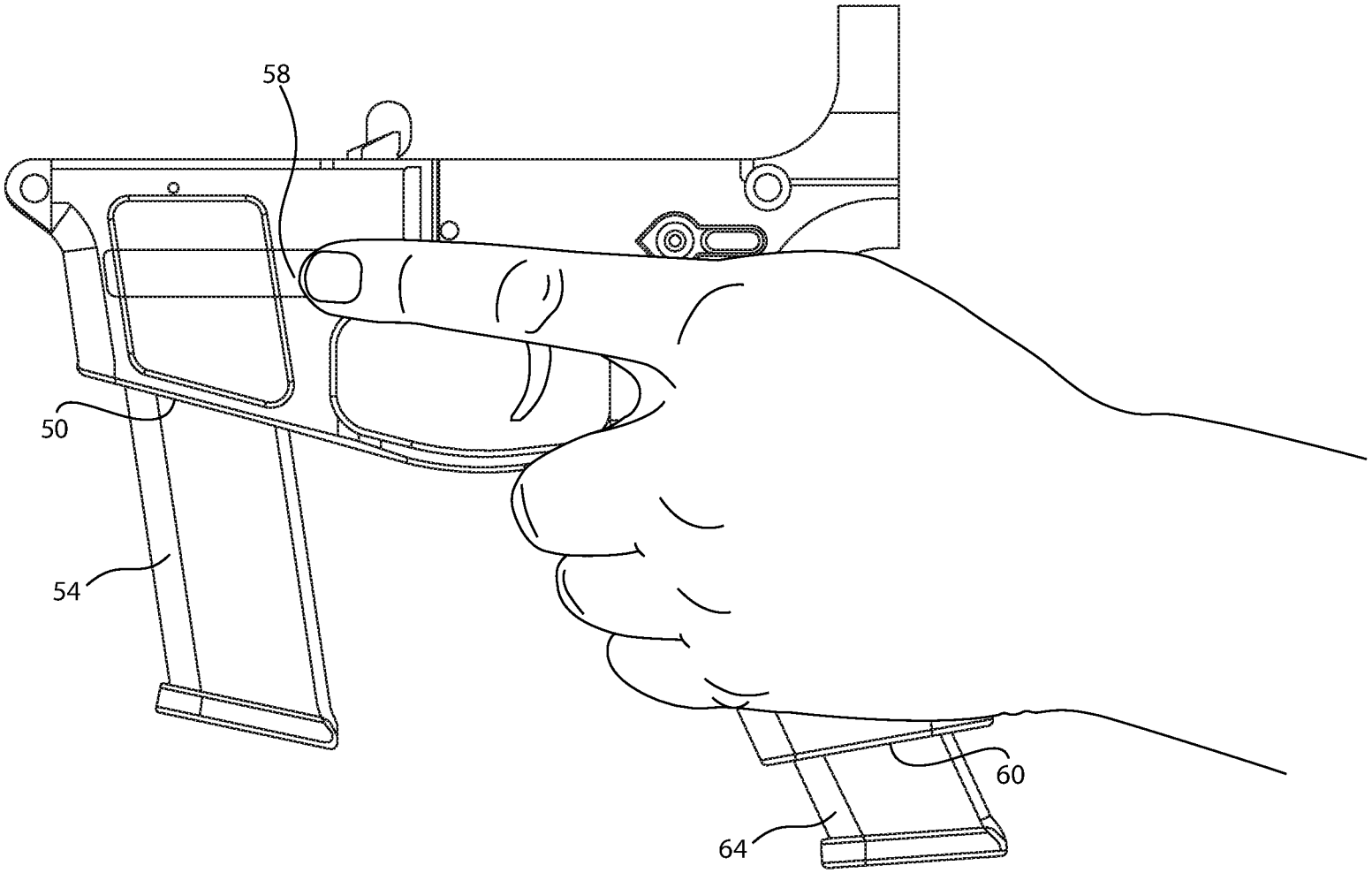
FIG. 10 is a side view of the firearm of FIG. 9 with a user releasing the operational magazine.

As illustrated in FIG. 10, after a user empties the operational magazine 54, the operational magazine release 58 can be actuated with the index finger on the user's predominant hand that is grasping the grip 70. The operational magazine 54 is thereby released from the operational magazine well.

Figure 11:
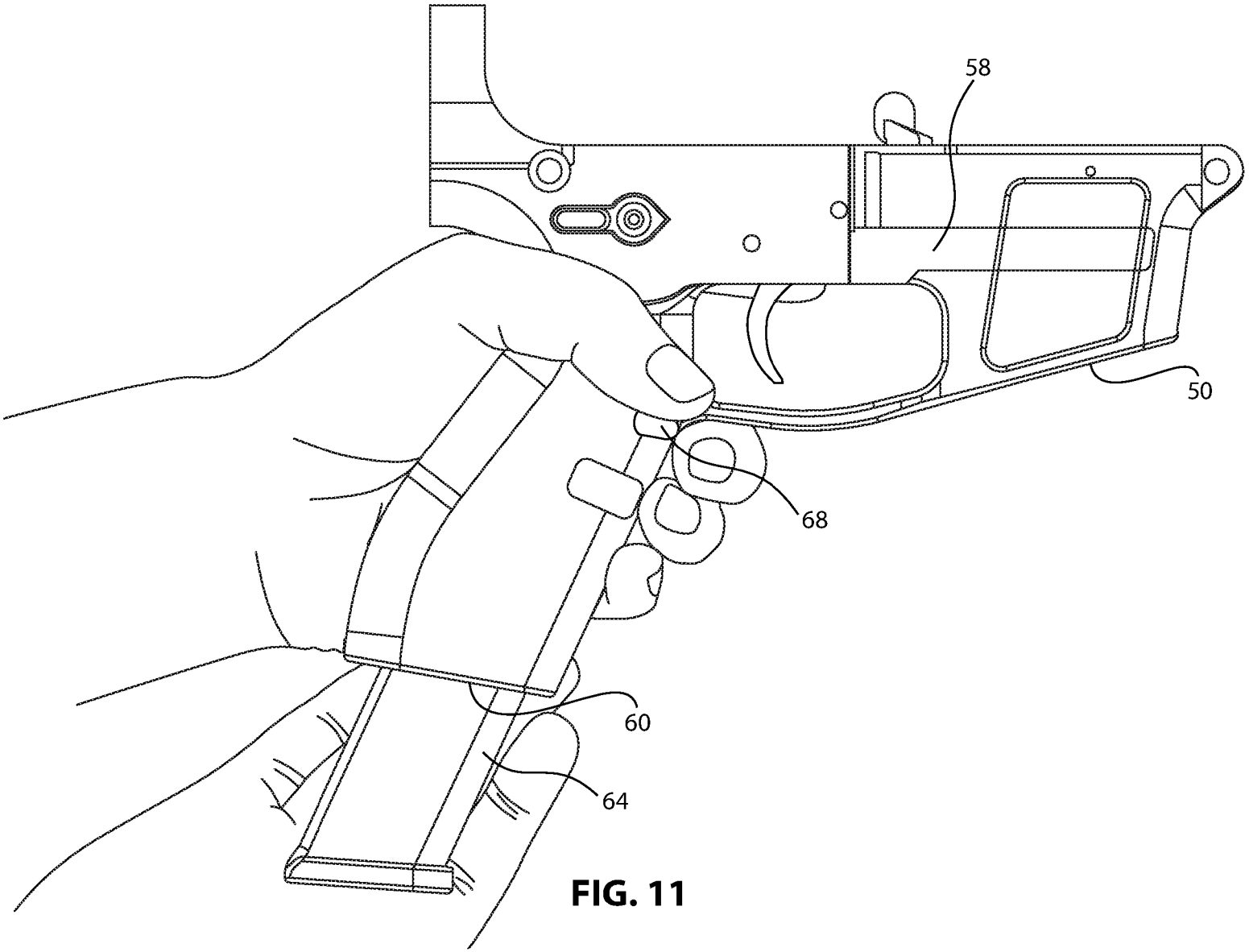
FIG. 11 is a side view of the firearm of FIG. 10 with a user releasing the secondary magazine.

As illustrated in FIG. 11, the user can then actuate the secondary magazine release 68 with their thumb on the same hand as the index finger that just released the operational magazine 54. The secondary magazine 64 is released from the secondary magazine well 60 and can be grasped with the user's secondary hand.

Figure 12:
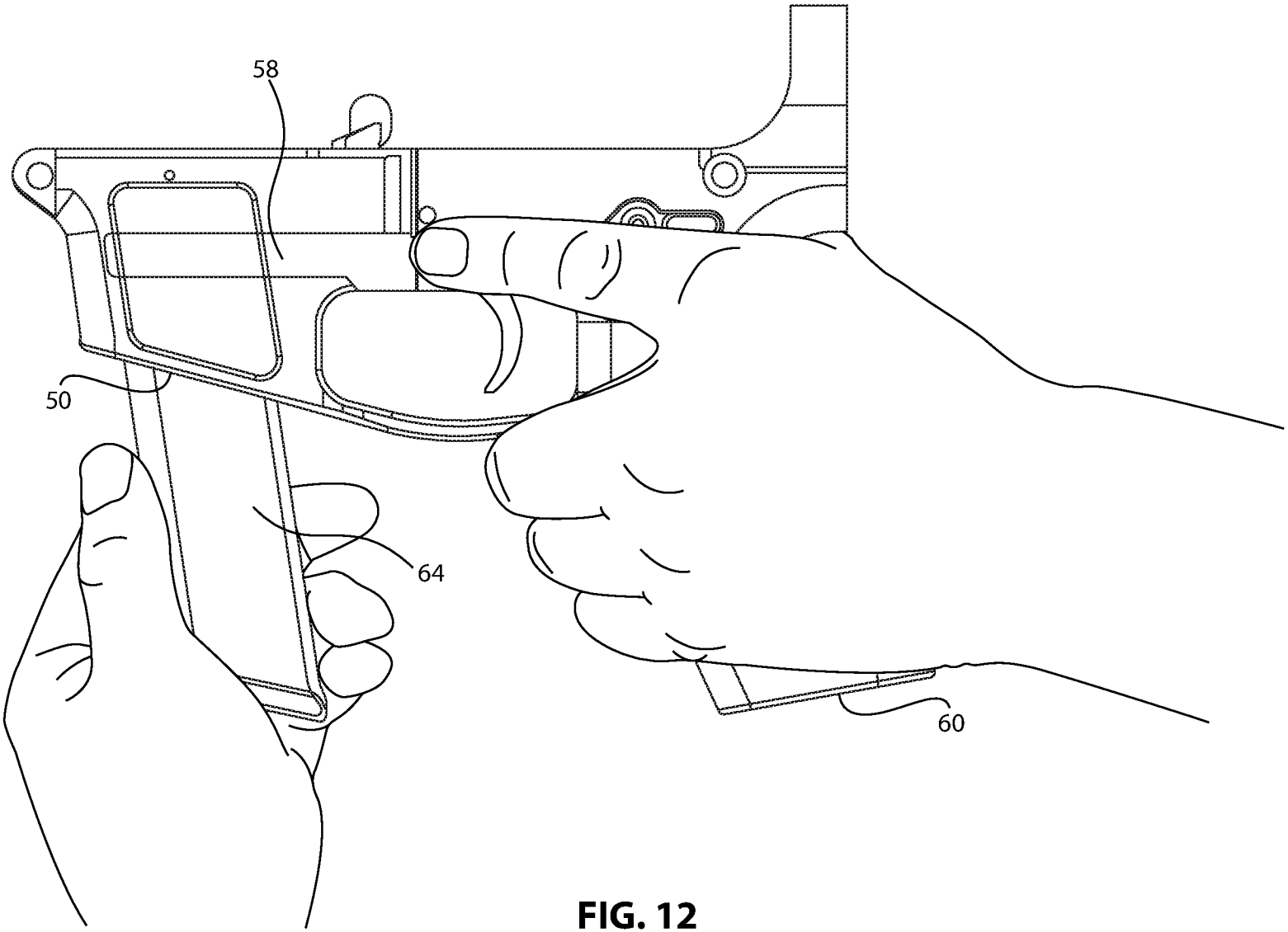
FIG. 12 is a side view of the firearm of FIG. 11 with a user loading the secondary magazine into the operational magazine well.

As illustrated in FIG. 12, the user can then insert the secondary magazine 64 into the operational magazine well 50.

In this way, reloading time can be significantly reduced and the user has a convenient storage system within the firearm frame for a secondary magazine. Moreover, the user can withdrawal a third magazine (not shown) and insert it into the secondary magazine well at a desired time. Another particular advantage of certain embodiments of the present disclosure is the interchangeability of the secondary magazine in the secondary magazine well with a secondary firearm, such as a handgun. A user could release the secondary magazine from the secondary magazine well and insert the magazine into a secondary firearm.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a firearm having an operational magazine well and a secondary magazine well has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A firearm comprising:

a grip;

a trigger located between the grip and a projectile exit end of a barrel;

a trigger guard positioned below the trigger;

a magazine well disposed within the grip and adapted to receive a magazine, wherein the magazine well is nonoperational;

a magazine release adapted to release the magazine from the magazine well, wherein the magazine release is positioned in line with the trigger guard; and a latch configured to hold the magazine within the magazine well;

wherein the grip comprises a first aperture and a second aperture, wherein the first aperture is configured to accommodate the latch and the second aperture is configured to accommodate the magazine release.

2. The firearm of claim 1, wherein the magazine release is ambidextrous.

3. The firearm of claim 1, wherein the magazine release is positioned above the latch.

4. A grip comprising:

a magazine well disposed within the grip and adapted to receive a magazine, wherein the magazine well is nonoperational;

a first aperture;

a second aperture;

a magazine release adapted to release the magazine from the magazine well; and a latch configured to hold the magazine within the magazine well;

wherein the first aperture is configured to accommodate the latch and the second aperture is configured to accommodate the secondary magazine release.

5. The grip of claim 4, wherein the magazine release is positioned above the latch.

* * * * *